US009592536B2

(12) United States Patent
Hamilton

(10) Patent No.: US 9,592,536 B2
(45) Date of Patent: Mar. 14, 2017

(54) SURFACE CLEANING

(75) Inventor: Sheila Hamilton, Kilmacolm (GB)

(73) Assignee: ITW LIMITED, Windsor, Berkshire (GB)

( * ) Notice: Subject to any disclaimer, the term of this patent is extended or adjusted under 35 U.S.C. 154(b) by 1419 days.

(21) Appl. No.: 12/566,374

(22) Filed: Sep. 24, 2009

(65) Prior Publication Data

US 2010/0078042 A1 Apr. 1, 2010

Related U.S. Application Data

(60) Provisional application No. 61/157,055, filed on Mar. 3, 2009.

(30) Foreign Application Priority Data

Sep. 26, 2008 (GB) ..... 0817657.0

(51) Int. Cl.

| | |
|---|---|
| ***B08B 7/00*** | (2006.01) |
| ***B08B 1/00*** | (2006.01) |
| ***B08B 1/02*** | (2006.01) |
| ***B08B 1/04*** | (2006.01) |

(52) U.S. Cl.

CPC ..... *B08B 1/00* (2013.01); *B08B 1/007* (2013.01); *B08B 1/02* (2013.01); *B08B 1/04* (2013.01); *B08B 7/0028* (2013.01)

(58) Field of Classification Search

USPC ..... 15/3, 102, 256.52, 230

See application file for complete search history.

(56) References Cited

U.S. PATENT DOCUMENTS

| | | | | |
|---|---|---|---|---|
| 6,560,426 | B2 * | 5/2003 | Sakaizawa et al. | 399/150 |
| 2002/0023307 | A1 * | 2/2002 | Haba et al. | 15/3 |
| 2003/0046783 | A1 | 3/2003 | Chen et al. | |

FOREIGN PATENT DOCUMENTS

| | | | |
|---|---|---|---|
| DE | 10108205 | A1 * | 9/2002 |
| EP | 1942519 | A1 | 7/2008 |
| GB | 2151988 | A * | 7/1985 |
| WO | 9924178 | A1 | 5/1999 |
| WO | 2005018879 | A1 | 3/2005 |
| WO | 2007034244 | A1 | 3/2007 |
| WO | 2008041000 | A2 | 4/2008 |

* cited by examiner

*Primary Examiner* — Shay Karls

(74) *Attorney, Agent, or Firm* — Hauptman Ham, LLP

(57) ABSTRACT

There is herein described an improved contact cleaning surface and an improved method for cleaning surfaces. More particularly, there is described a contact cleaning surface comprising a micro-structured surface adapted to collect and/or remove microscopically sized contaminating material from a contaminated surface.

16 Claims, 4 Drawing Sheets

SURFACE CLEANING

CROSS-REFERENCE TO RELATED APPLICATIONS

This application claims priority under the provisions of 35 U.S.C. §119 of U.K. Patent Application No. 0817657.0 filed Sep. 26, 2008 and further claims priority under the provisions of 35 U.S.C. §120 of U.S. Provisional Patent Application No. 61/157,055 filed Mar. 3, 2009. The disclosures of all of the foregoing applications are hereby incorporated herein by reference in their respective entireties, for all purposes.

FIELD OF THE INVENTION

The present invention relates to an improved contact cleaning surface and an improved method for cleaning surfaces. More particularly, the present invention relates to a contact cleaning surface comprising a micro-structured surface adapted to collect and/or remove microscopically sized contaminating material from a contaminated surface.

BACKGROUND OF THE INVENTION

There is an increasing trend towards coatings containing nanoparticles being applied to webs to enhance their functionality and, in particular, their optical properties. These coatings are extremely thin and as such are very susceptible to defects caused by microscopic particles of contamination on the surface of the web. The only effective method of removing such small particles from the surface of sensitive webs is through the use of contact cleaning technology. However, because this involves touching the surface of the web with a cleaning roller there is an interfacial reaction between the roller and the substrate which can have a detrimental effect on the quality of extremely thin coated layers. There is therefore a growing need in contact cleaning technology to mitigate the interfacial reaction while providing particle removal down to the submicron level.

In particular, the growing markets for plastic electronics, photovoltaics and flat panel displays are driving the web coating industry towards the limits of current coating technology by demanding thinner, more consistent, defect free coatings. This level of quality can impact process yields and therefore increase costs for the coating company.

Contact cleaning in conjunction with adhesive rolls is commonly used to clean substrate surfaces in the manufacture of electronic components. For example, we refer to WO99/24178, WO2007/034244 and WO2008/041000 which are incorporated herein by reference. However, existing systems are not capable of efficiently removing small particles such as in the range of about 10 nm to about 10 microns (10,000 nm).

Whilst precautions can be taken to minimise surface contamination using, for example, air filtration to trap airborne dust particles, it is desirable to be able to clean surfaces in a manner that avoids damage to or dissolution of a substrate surface being cleaned, and is preferably easy to perform.

It is an object of at least one aspect of the present invention to obviate or mitigate at least one or more of the aforementioned problems.

It is a further object of at least one aspect of the present invention to provide a contact cleaning surface capable of providing improved cleaning to a contaminated surface.

It is a further object of at least one aspect of the present invention to provide a contact cleaning surface capable of collecting and/or removing microscopically sized contaminating material from a contaminated surface.

It is a yet further object of at least one aspect of the present invention to provide an improved contact cleaning method capable of providing improved cleaning to a contaminated surface.

It is a yet further object of at least one aspect of the present invention to provide an improved contact cleaning method capable of collecting and/or removing microscopically sized contaminating material from a contaminated surface.

SUMMARY OF THE INVENTION

According to a first aspect of the present invention there is provided a contact cleaning surface comprising:

a cleaning surface;

wherein at least part of the cleaning surface is microscopically roughened and the microscopically roughened surface is capable of enhancing collection and/or removal of small contaminating particles from a contaminated surface.

The contact cleaning surface may therefore be used to clean surfaces which are contaminated with microscopically sized particles. In particular, the contact cleaning as defined in the present invention has surprisingly been found to be extremely useful in cleaning surfaces which are intended to form electronic components such as plastic electronics, photovoltaics and flat panel displays.

The present invention is therefore useful in the increasing trend towards coatings containing nanoparticles being applied to webs to enhance their functionality and, in particular, their optical properties.

Typically, all or substantially all of the cleaning surface may be microscopically roughened to increase the efficiency of the collection and/or removal of the contaminating particles.

The cleaning surface which is microscopically roughened may be used to increase and/or maximise surface area contact between the cleaning surface and the small particles causing the contamination. This has been found to surprisingly increase the collection and/or removal of the contaminating particles. Although not wishing to be bound by theory this improvement is thought to be due to an increase in van der Waals forces between the contact cleaning surface and the contaminating particles due to the increased surface area contact. The increase in van der Waals forces compared to that of a completely smooth surface as presently used in the prior art has been found to be of the order of an increase of at least about 50%.

To increase the surface area contact, the cleaning surface may therefore be roughened with, for example, the aim of providing small indentations on the surface which may be used to capture and/or remove the small contaminating particles. The cleaning surface may therefore comprise a plurality of such indentations in, for example, a random or constant pattern. By indentation is meant any type of hollow, notch, recess, cut, depression, dimple, dip, nick and/or pit.

The shape and/or size of the indentions may be substantially uniform or may be substantially non-uniform. In embodiments where the shape and/or size of the indentions are substantially non-uniform, the shape and/or size of the indentions may therefore extend over a range of shapes and/or sizes thereby providing the cleaning surface with the capability of maximising the collection of contaminated particles over a range of differently sized contaminating particles.

The microscopically roughened cleaning surface may therefore comprise a plurality of small indentations adapted to improve and/or maximise the collection and/or removal of small contaminating particles.

The cleaning surface may be microscopically roughened using any suitable mechanical and/or chemical technique. For example, any suitable mechanical means, moulding means and/or laser structuring means may be used to microscopically roughen the cleaning surface.

The microscopically roughened surface may therefore comprise a series or plurality of indentations with microscopically sized cross-sectional diameters and depths. It is highly preferred that the shape of the indentations may be specifically designed to match the shape of the contaminating particles. This means that the contaminating particles may snugly fit into the indentations therefore allowing the contaminating particles to be removed form a contaminated surface. The contaminating particles may therefore become lodged and/or attached within the indentations during the cleaning process. The present invention may therefore be seen as a method of increasing adhesion forces between the cleaning surface and the contaminating particles such that the force is greater than the force between the contaminating particles and the contaminated surface from which they are originally attached to.

For example, the microscopically roughened surface may comprise indentations with a cross-sectional diameter and/or depth ranging from any one of or combination of the following: less than about 10 microns (10,000 nm); less than about 5 microns (5,000 nm); less than about 1 micron (1,000 nm); less than about 0.1 microns (100 nm); less than about 0.01 micron (10 nm); or less than about 0.005 micron (5 nm). Alternatively, the microscopically roughened surface may comprise indentations with a cross-sectional diameter and/or depth ranging from any one of or combination of the following: about 1 nm to about 10 microns (10,000 nm); about 10 nm to about 10 microns (10,000 nm); about 10 nm to about 1 micron (1,000 nm); about 10 nm to about 0.1 microns (100 nm); or about 1 nm to about 0.01 microns (10 nm). As indicated above, the microscopically roughened surface may comprise indentations with a combination of different cross-sectional diameters and/or depths allowing a range of differently sized contaminating material to be collected and/or removed. By cross-sectional diameter is meant the maximum diameter formed by the indentation. By depth is meant the vertical distance between the bottom part of the indentation and the top part of the cleaning surface.

In particular embodiments, there may be about 10 to about 100,000 indentations per $cm^2$, about 100 to about 10,000 indentations per $cm^2$ or about 100 to about 5,000 indentations per $cm^2$ of the contact cleaning surface.

The small contaminating particles being collected may substantially match the shape and/or dimensions of the indentations and may therefore have a cross-sectional diameter ranging from any one of or combination of the following: less than about 10 microns (10,000 nm); less than about 5 microns (5,000 nm); less than about 1 micron (1,000 nm); less than about 0.1 microns (100 nm); less than about 0.01 micron (10 nm); or less than about 0.005 micron (5 nm). Alternatively, the small particles being collected may have a cross-sectional diameter ranging from any one of or combination of the following: about 1 nm to about 10 microns (10,000 nm); about 10 nm to about 10 microns (10,000 nm); about 10 nm to about 1 micron (1,000 nm); about 10 nm to about 0.1 microns (100 nm); or about 1 nm to about 0.01 microns (10 nm).

Conveniently, the indentations may be of a size and shape that about 20%, 30%, 40%, 50%, 60%, 70% or 80% of the volume of the contaminating particles may fit into the recess formed by the indentations. This means that about 20%, 30%, 40%, 50%, 60%, 70% or 80% of the total surface area of the contaminating particles may be in contact with the cleaning surface as they are collected and/or removed from the contaminated surface.

The cleaning surface may also be electrostatically charged to assist in the collection and/or removal of the contaminating particles.

The cleaning surface may be made from any suitable material. For example, the cleaning surface may be made from or comprise elastomer material.

In particular embodiments, the cleaning surface may be in the form of a roller such as a substantially cylindrical roller which may be rotated and/or urged against a surface to be cleaned.

The cleaning surface may therefore be placed in contact and/or urged against a surface to be cleaned using any suitable means.

According to a second aspect of the present invention there is provided a method of cleaning a surface contaminated with small particles, said method comprising:

providing a cleaning surface which is at least partially microscopically roughened to enhance collection and/or removal of small contaminating particles from a contaminated surface;

contacting and/or urging the cleaning surface against the contaminated surface;

wherein on contacting and/or urging the cleaning surface against the contaminated surface at least some or substantially all of the small contaminating particles on the contaminated surface are capable of being collected and/or removed.

Typically, all or substantially all of the cleaning surface may be microscopically roughened to increase the efficiency of the removal of the contaminating particles.

For example, the microscopically roughened surface may comprise indentations with a cross-sectional diameter and/or depth ranging from any one of or combination of the following: less than about 10 microns (10,000 nm); less than about 5 microns (5,000 nm); less than about 1 micron (1,000 nm); less than about 0.1 microns (100 nm); less than about 0.01 micron (10 nm); or less than about 0.005 micron (5 nm). Alternatively, the microscopically roughened surface may comprise indentations with a cross-sectional diameter and/or depth ranging from any one of or combination of the following: about 1 nm to about 10 microns (10,000 nm); about 10 nm to about 10 microns (10,000 nm); about 10 nm to about 1 micron (1,000 nm); about 10 nm to about 0.1 microns (100 nm); or about 1 nm to about 0.01 microns (10 nm). As indicated above, the microscopically roughened surface may comprise indentations with a combination of different cross-sectional diameters and/or depths allowing a range of differently sized contaminating material to be collected and removed.

The small contaminating particles being collected may substantially correspond to the shape and/or dimensions of the indentations and may therefore have a cross-sectional diameter ranging from any one of or combination of the following: less than about 10 microns (10,000 nm); less than about 5 microns (5,000 nm); less than about 1 micron (1,000 nm); less than about 0.1 microns (100 nm); less than about 0.01 micron (10 nm); or less than about 0.005 micron (5 nm). Alternatively, the small particles being collected may have a cross-sectional diameter ranging from any one of or combination of the following: about 1 nm to about 10 microns (10,000 nm); about 10 nm to about 10 microns (10,000 nm); about 10 nm to about 1 micron (1,000 nm); about 10 nm to about 0.1 microns (100 nm); or about 1 nm to about 0.01 microns (10 nm).

Typically, the cleaning surface may be rotated against the surface contaminated with small particles with a speed of about 0.1 cm/s to about 5 cm/s.

The cleaning surface may therefore be as defined in the first aspect.

According to a third aspect of the present invention there is provided surface cleaning apparatus for cleaning contaminated surfaces, said surface cleaning apparatus comprising:

a rotatably mounted surface cleaning roller capable of removing contaminating small microscopic particles from a contaminated surface;

a rotatably mounted adhesive roller capable of removing the contaminating small particles collected on the rotatably mounted surface cleaning roller;

means capable of urging a surface contaminated with small particles against the rotatably mounted surface cleaning roller;

wherein at least part of the surface of the rotatably mounted surface cleaning roller is microscopically roughened and the microscopically roughened surface is capable of enhancing collection and/or removal of small microscopic contaminating particles from the contaminated surface.

Typically, the means capable of urging the surface contaminated with small particles against the rotatably mounted surface cleaning roller may be mounted substantially opposite the rotatably mounted surface cleaning roller.

Motorised means may also be provided for driving the rotatably mounted surface cleaning roller and the rotatably mounted adhesive roller.

The rotatably mounted surface cleaning roller and the rotatably mounted adhesive roller may rotate in opposite directions.

The apparatus in certain embodiments may comprise a pair of rotatably mounted surface cleaning rollers and rotatably mounted adhesive rollers on both sides a substrate being cleaned.

The rotatably mounted adhesive roller may comprise at least one or a plurality of adhesive sheets which may be peeled off and removed when the adhesive sheet has become saturated with contaminated material or the efficiency of the adhesive sheet has reduced. The rotatably mounted adhesive roller may therefore be in the form of a pre-sheeted adhesive roll.

The rotatably mounted surface cleaning roller may therefore comprise a cleaning surface as defined in the first aspect.

The apparatus may be used in the manufacture of electronic components such as plastic electronics, photovoltaics and flat panel displays.

According to a fourth aspect of the present invention there is provided a method for cleaning contaminated surfaces, said method comprising:

providing a rotatably mounted surface cleaning roller capable of removing contaminating small particles from a contaminated surface;

providing a rotatably mounted adhesive roller capable of removing the contaminating small particles collected on the rotatably mounted surface cleaning roller;

providing means capable of urging a surface contaminated with small particles against the rotatably mounted surface cleaning roller;

wherein at least part of the surface of the rotatably mounted surface cleaning roller is microscopically roughened and the microscopically roughened surface is capable of enhancing collection and/or removal of small microscopic contaminating particles from the contaminated surface.

The rotatably mounted surface cleaning roller therefore comprises a cleaning surface as defined in the first aspect.

BRIEF DESCRIPTION OF THE DRAWINGS

Embodiments of the present invention will now be described, by way of example only, with reference to the accompanying drawings in which.

BRIEF DESCRIPTION

Figure 1:
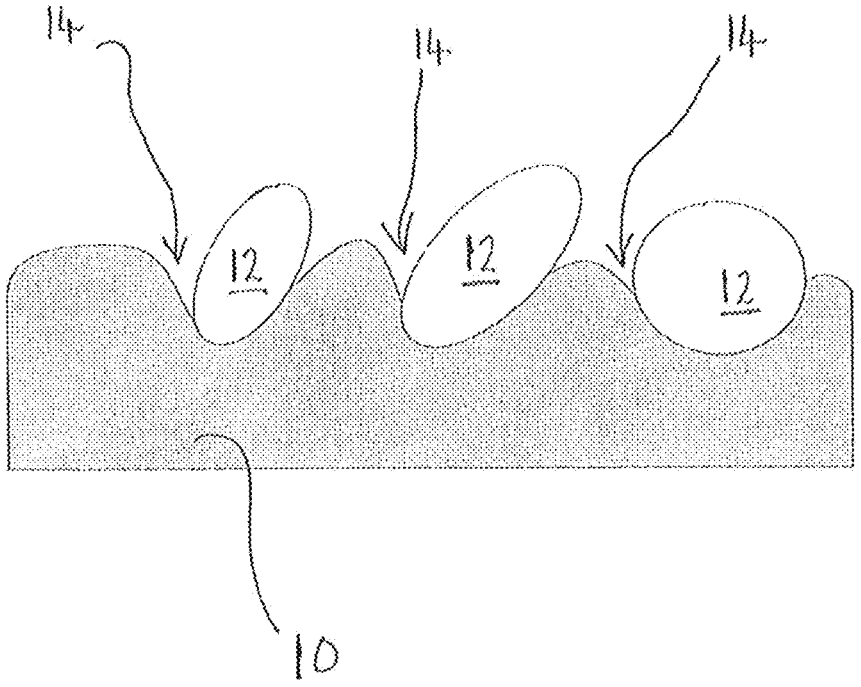
FIG. 1 is a representation of contaminating particles on a cleaning surface according to an embodiment of the present invention.

FIG. 1 is a representation of a contact cleaning surface 10 according to the present invention. As shown in FIG. 1 contaminating particles 12 snugly fit and are lodged into indentations 14 on the contact cleaning surface 10. It can be seen that the indentations 14 have a substantially similar size and shape to the contaminating particles 12 (i.e. they substantially match). There is therefore a large contact surface area between the indentations 14 and the contaminating particles 12. The indentations 14 have a cross-sectional diameter and a depth of less than about 5 microns (5,000 nm). This has been surprisingly found to increase the collection and/or removal of the contaminating particles 12 from a contaminating surface. Although not wishing to be bound by theory this is thought to be due to an increase in van der Waals forces between the contact cleaning surface 10 and the contaminating particles 12.

Figure 2:
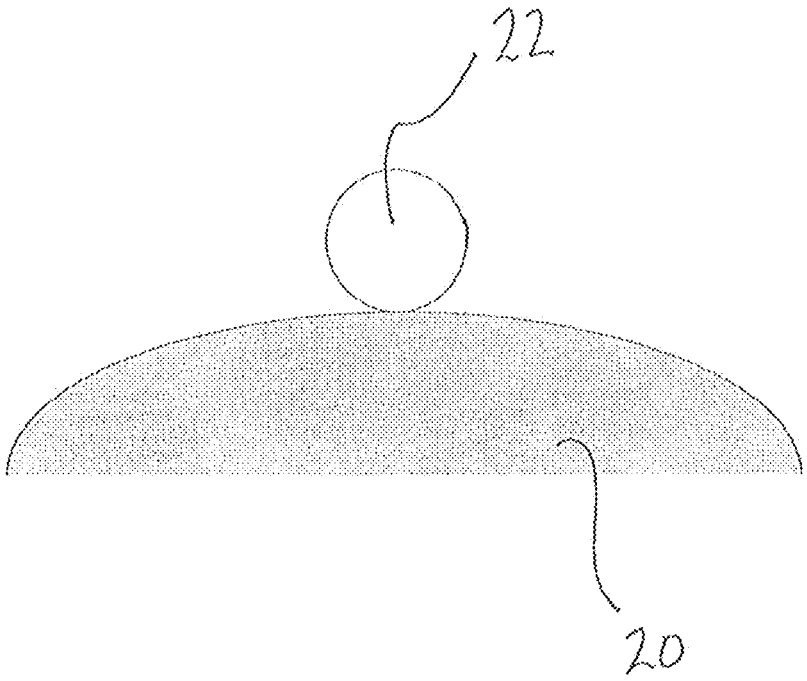
FIG. 2 is a representation of a contaminating particle on a cleaning surface according to the prior art.

FIG. 2 is a representation of the prior art. The contact cleaning surface 20 in FIG. 2 is of a substantially smooth convex structure. This has the effect of reducing the contact area between contaminating particle 22 and the contact cleaning surface 20. The contact cleaning surface 20 will therefore have a relatively small van der Waals force towards the contaminating particle 22 as there is minimal contact area. The contact cleaning surface 20 will therefore not be efficient in removing contaminating particle 22 from a contaminated surface.

Figure 3:
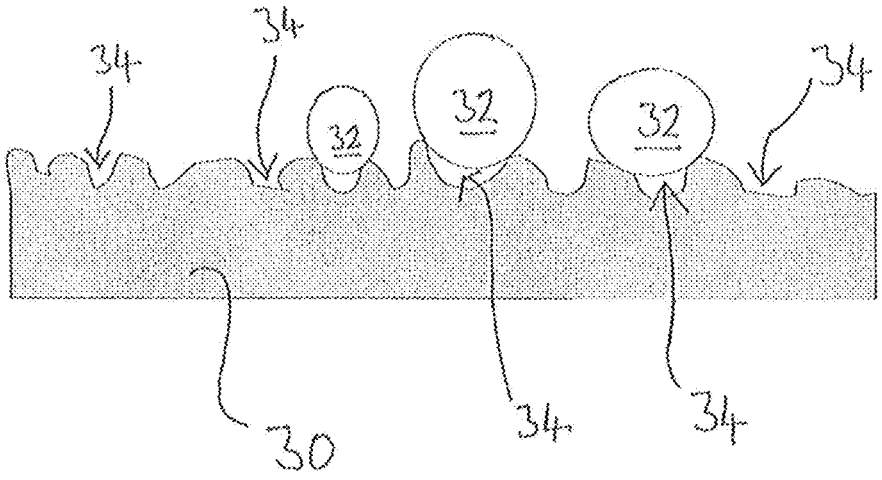
FIG. 3 is a representation of contaminating particles on a further cleaning surface where the contaminating particles are too large to fit into indentations on a cleaning surface.

FIG. 3 is a representation where contaminating particles 32 are too large to fit within indentations 34. This again reduces surface contact between contact cleaning surface 30 and the contaminating particles 32. There is therefore reduced van der Waals forces between contact cleaning surface 30 and contaminating particles 32 meaning that contact cleaning surface 30 will not efficiently remove contaminating particles 32 from a contaminated surface.

Figure 4:
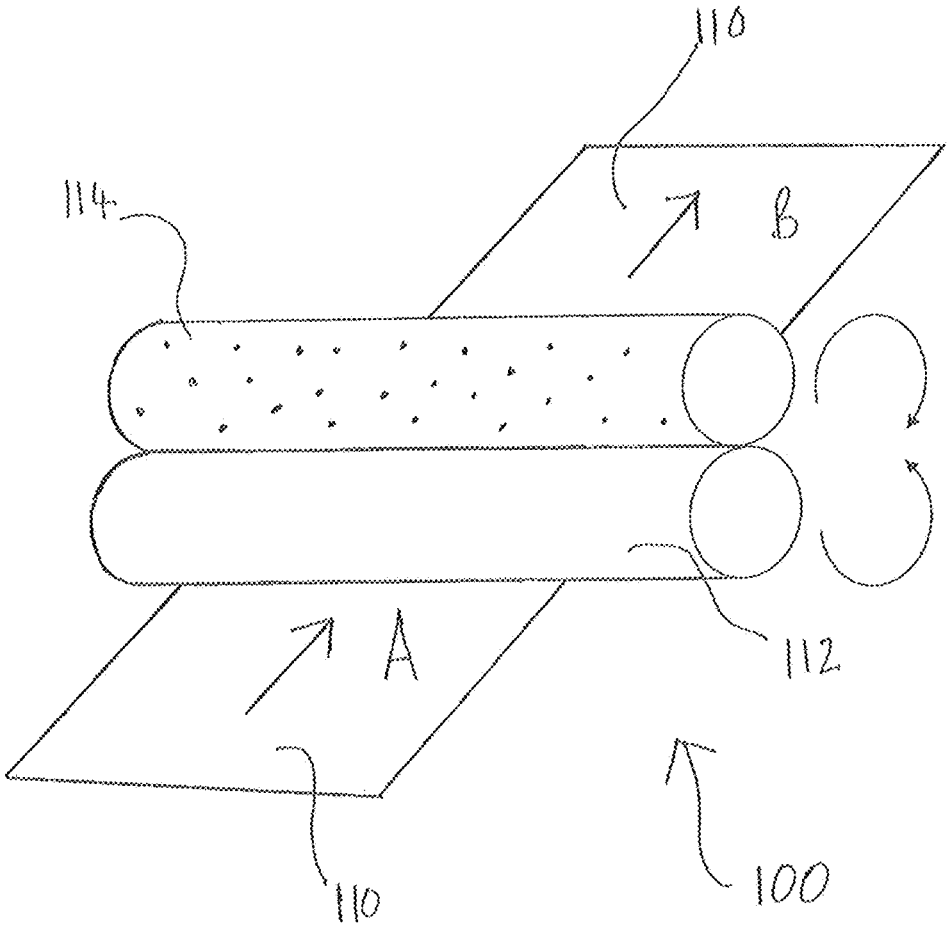
FIG. 4 is a representation of surface cleaning apparatus according to a further embodiment of the present invention.

FIG. 4 is a representation of surface cleaning apparatus according to the present invention, generally designated 100. As shown in FIG. 4 the surface cleaning apparatus 100 comprises a contact cleaning roller 112 and an adhesive roller 114. The contact cleaning roller 112 collects and removes contaminated material from substrate 110. Urging means (not shown) force the substrate 110 against the contact cleaning roller 112. The contact cleaning roller 112 comprises a roughened surface as defined in the present invention. The surface of the contact cleaning roller 112 therefore comprises a plurality of indentations suitable for removing contaminating small debris from the substrate 110. The indentations are in the form of a micro-structured surface adapted to collect and/or remove microscopically sized contaminating material from a contaminated surface. As shown in FIG. 4, the contact cleaning roller 112 counter-rotates against the adhesive roller 114 which removes contaminated particles formed on the contact cleaning roller 112.

The region identified by reference 'A' in the substrate 110 is therefore uncleaned and the region identified by reference 'B' is cleaned and may then be used in the improved manufacture of electronic components such as plastic electronics, photovoltaics and flat panel displays The indentations in the contact cleaning roller 112 have a cross-sectional diameter and/or depth ranging from less than about 5 microns (5,000 nm). The indentations are also of substantially similar shape and size to the contaminating particles to enhance their collection and/or removal.

Whilst specific embodiments of the present invention have been described above, it will be appreciated that departures from the described embodiments may still fall within the scope of the present invention. For example, any suitable type of microscopically roughened structure may be used to collect and/or remove contaminating material from a contaminated surface.

The invention claimed is:

1. A contact cleaning surface comprising:

a cleaning surface;

wherein at least a part of the cleaning surface is microscopically roughened for enhancing collection and/or removal of small contaminating particles from a contaminated surface, the microscopically roughened surface includes indentations on the cleaning surface, the indentations having a cross-sectional diameter and depth of less than five microns (5,000 nm).

2. A contact cleaning surface according to claim 1, wherein all or substantially all of the cleaning surface is microscopically roughened to increase the efficiency of the collection and/or removal of the contaminating particles.

3. A contact cleaning surface according to claim 1, wherein the cleaning surface which is microscopically roughened increases and/or maximises surface area contact between the cleaning surface and the small contaminating particles.

4. A contact cleaning surface according to claim 1, wherein the indentations are configured for capturing and/or removing the small contaminating particles.

5. A contact cleaning surface according to claim 4, wherein the shape and/or size of the indentions is substantially uniform.

6. A contact cleaning surface according to claim 4, wherein the shape and/or size of the indentions is substantially non-uniform and therefore extends over a range of sizes thereby enhancing the collection and/or removal of the contaminating particles over a range of differently sized contaminating particles.

7. A contact cleaning surface according to claim 1, wherein the indentations are in a random or constant pattern.

8. A contact cleaning surface according to claim 1, wherein the cleaning surface is microscopically roughened using mechanical, moulding and/or laser structuring techniques.

9. A contact cleaning surface according to claim 1, wherein the indentations have various cross-sectional diameters and/or depths ranging from any one of or combination of the following: less than about 5 microns (5,000 nm); less than about 1 micron (1,000 nm); less than about 0.1 microns (100 nm); less than about 0.01 micron (10 nm); or less than about 0.005 micron (5 nm).

10. A contact cleaning surface according to claim 1, wherein the indentations have various cross-sectional diameters and/or depths ranging from any one of or combination of the following: about 10 nm to about 1 micron (1,000 nm); about 10 nm to about 0.1 microns (100 nm); or about 1 nm to about 0.01 microns (10 nm).

11. A contact cleaning surface according to claim 1, wherein the cleaning surface is made from or comprises elastomer material.

12. A contact cleaning surface according to claim 1, wherein the cleaning surface is in the form of a roller or a substantially cylindrical roller which is configured to be rotated and/or urged against a surface to be cleaned.

13. A surface cleaning apparatus for cleaning contaminated surfaces, said surface cleaning apparatus comprising:

a rotatably mounted surface cleaning roller for removing contaminating small particles from a contaminated surface;

a rotatably mounted adhesive roller for removing the contaminating small particles collected on the rotatably mounted surface cleaning roller; and means for urging a surface contaminated with small particles against the rotatably mounted surface cleaning roller;

wherein at least a part of the surface of the rotatably mounted surface cleaning roller is microscopically roughened for enhancing collection and/or removal of small microscopic contaminating particles from the contaminated surface, the microscopically roughened surface includes indentations on the cleaning surface, the indentations having a cross-sectional diameter and depth of less than five microns (5,000 nm).

14. A surface cleaning apparatus according to claim 13, wherein said means is mounted substantially opposite the rotatably mounted surface cleaning roller.

15. A surface cleaning apparatus according to claim 13, further comprises a motor for driving the rotatably mounted surface cleaning roller and the rotatably mounted adhesive roller.

16. A surface cleaning apparatus according to claim 13, wherein the apparatus comprises a pair of rotatably mounted surface cleaning rollers and rotatably mounted adhesive rollers on both sides of a substrate to be cleaned.

* * * * *